United States Patent [19]

Bryant

[11] 4,381,088

[45] Apr. 26, 1983

[54] BOBBIN CORE

[75] Inventor: Randy E. Bryant, Alliance, Nebr.

[73] Assignee: Dayco Corporation, Dayton, Ohio

[21] Appl. No.: 192,752

[22] Filed: Oct. 1, 1980

[51] Int. Cl.[3] ..... B65H 75/14

[52] U.S. Cl. ..... 242/118.7; 242/118.3

[58] Field of Search ..... 242/118, 118.3, 118.31, 242/118.32, 118.7, 46.2, 46.21, 68.5; 64/27 F

[56] References Cited

U.S. PATENT DOCUMENTS

| | | | |
|---|---|---|---|
| 2,236,178 | 3/1941 | Kennedy | 242/46.21 |
| 2,751,936 | 6/1956 | Dunlap et al. | 242/118.32 |
| 3,248,065 | 4/1966 | Winslow | 242/46.21 |
| 3,593,933 | 7/1971 | Grashorn | 242/46.4 |
| 3,860,194 | 1/1975 | Roscher | 242/118.32 |
| 4,063,689 | 12/1977 | Brovelli | 242/46.5 |

*Primary Examiner*—Leonard D. Christian

*Attorney, Agent, or Firm*—Joseph V. Tassone

[57] ABSTRACT

A tubular core for carrying yarn wound therearound to define a bobbin for a textile machine, and method of making such core are provided, wherein the core has a load-carrying structure and an inside portion which is adapted to be engaged by a carrier shaft to provide substantially frictional holding of the core and bobbin on the shaft and wherein such inside portion comprises a sleeve made of a yieldable resilient polymeric material which is adapted to be yieldingly compressed between the structure and at least parts of the shaft to provide the frictional holding of the core in an improved manner and the yieldable resilient material of the sleeve enables the core and bobbin to be driven on the shaft while keeping such core substantially intact as well as enabling damage-free removal thereof to thereby define a reusable core.

13 Claims, 9 Drawing Figures

BOBBIN CORE

BACKGROUND OF THE INVENTION

1. Field of the Invention

This invention relates to a tubular bobbin core and method of making same.

2. Prior Art Statement

The textile industry utilizes numerous bobbins each comprised of a tubular core having yarn wound therearound and such bobbins are used in numerous applications. For example, in one application such bobbins are used on a braiding machine wherein each tubular core is disposed concentrically around an associated carrier shaft which has a plurality of protruding shaft portions which serve to frictionally hold the core and its bobbin on such shaft. In such a braiding machine the tubular core of each bobbin is driven on its carrier shaft utilizing a rubber mallet, or the like, and often it is necessary to impact the end of the core with such mallet at an angle thereby placing unnecessary loads on the carrier shaft and associated supporting components.

A current tubular bobbin core widely used on such a braiding machine is made of a paper strip which has adhesive means applied to a surface thereof. The strip is then wound to define a tubular construction which is subjected to a heated environment to provide drying of the overall tubular construction and its adhesive means. The tubular construction is then cut to define at least one tubular paper core having an inside paper portion which is adapted to be frictionally held on an associated carrier shaft.

SUMMARY

It has been found that the above-described current paper core does not provide optimum frictional holding thereof on its carrier shaft. In addition, upon driving such a paper core in position on its shaft there is damage to the core which requires scrapping thereof after its yarn is expended. Further, such a paper core does not cushion its carrier shaft and associated equipment against impact loads produced by a mallet. Finally, such a paper core is prone to damage upon removal thereof from its shaft which may also require scrapping.

It is a feature of this invention to provide an improved tubular core for carrying yarn wound therearound to define a bobbin for a textile machine wherein the core has a load-carrying structure and an inside portion which is adapted to be engaged by a carrier shaft to provide substantially frictional holding of the core and bobbin on the shaft.

For example, in accordance with this invention an improved core is provided which has an inside portion comprised of a sleeve made of a yieldable resilient polymeric material which is adapted to be yieldingly compressed between its load-carrying structure and at least parts of the carrier shaft to provide the frictional holding of the core in an improved manner, and the yieldable resilient material of the sleeve enables the core and bobbin to be driven on the shaft while keeping the core substantially intact as well as enabling substantially damage-free removal thereof to thereby define a reusable core.

Another feature of this invention is to provide an improved tubular core of the character mentioned which is adapted to be driven on a carrier shaft by a mallet, or the like, with minimum loads imposed on the carrier shaft and associated supporting components.

Another feature of this invention is to provide an improved method of making a tubular core of the character mentioned.

Therefore, it is an object of this invention to provide an improved tubular bobbin core and method of making same having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DETAILED DESCRIPTION

Figure 1:
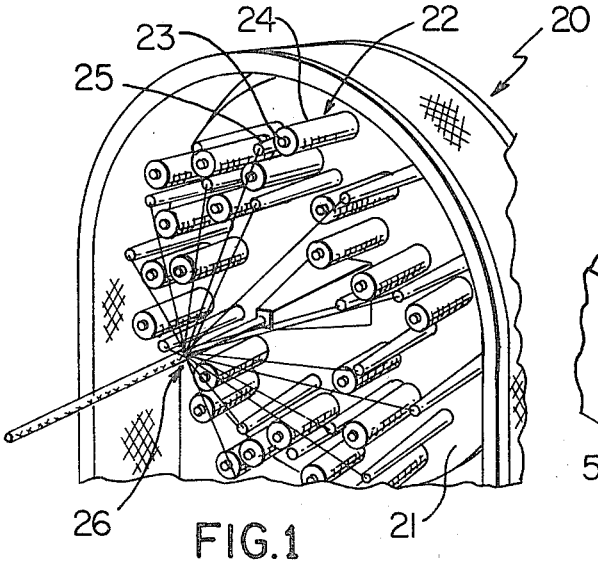
FIG. 1 is a perspective view with parts broken away particularly illustrating an exemplary textile machine which utilizes tubular bobbin cores made in accordance with the teachings of this invention to comprise bobbins utilized on such machine.

Reference is now made to FIG. 1 of the drawing which illustrates an exemplary textile machine, shown as a braiding machine, which is designated generally by the reference numeral 20, and, the machine 20 has a rotatable head 21 which carries a plurality of bobbins 22. Each bobbin 22 is comprised of a tubular core 23 made in accordance with the teachings of this invention and has yarn 24 wound around the core. The yarn 24 from each bobbin is supplied to an associated yarn feed device 25 which may have integral yarn tensioning means (not shown) provided therein and each yarn 24 is then conveyed to the central portion of the braiding machine and wound around a tubular hose, or the like, which may be supported on a supporting mandrel as shown at 26 in FIG. 1 to provide a braided cover around such hose. The detailed operation of the braiding machine 20 is known in the art and thus will not be described herein.

The core 23 of each bobbin 22 has an outer load-carrying structure 30 and an inside portion 31 which is adapted to be engaged by an associated carrier shaft 32 (FIG. 2) to provide substantially frictional holding of the core 23 on such shaft.

Figure 2:
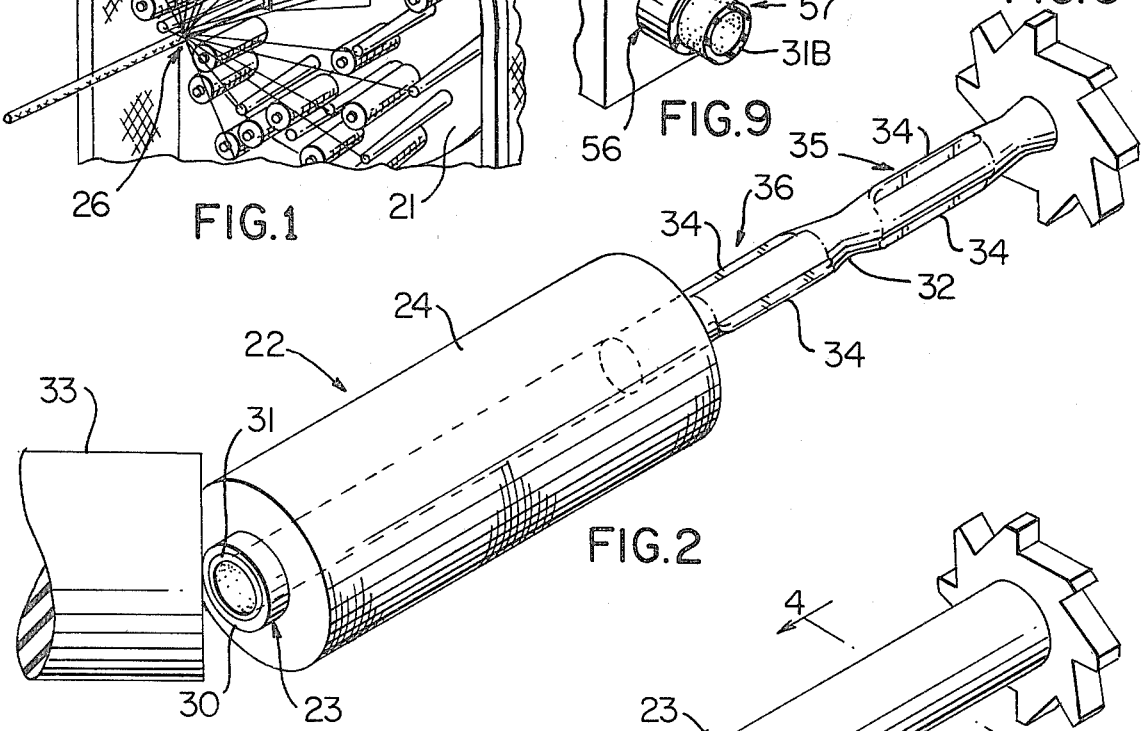
FIG. 2 is an exploded perspective view particularly illustrating a bobbin which has an exemplary tubular core of this invention comprising same and showing such core and bobbin being mallet driven on an associated carrier shaft.

In accordance with the teachings of this invention the inside portion 31 is in the form of a tubular sleeve which is made of a yieldable resilient polymeric material and the polymeric material is adapted to be yieldingly compressed between the load-carrying structure 30 and at least parts of the shaft 32 to provide frictional holding of the core 23 and hence the associated overall bobbin 22 on the shaft 32 in an improved manner. The yieldable resilient material of the sleeve 31 enables the core 23 and bobbin 22 to be driven on the shaft 32 by a mallet 33 as illustrated in FIG. 2 while keeping such core substantially intact, i.e., damage-free, as well as enabling damage-free removal of such core and bobbin from the shaft to thereby define a reusable core. Accordingly, inasmuch as the core 23 is not damaged during either its installation or removal it may be reused once its yarn is depleted, in much the same manner as a new core would be used initially. Each core 23 may be reused a number of times to produce substantial cost savings.

Figure 3:
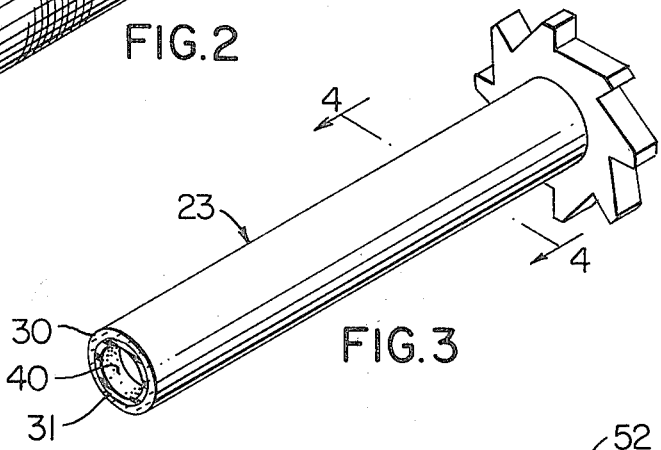
FIG. 3 is a perspective view illustrating the tubular bobbin core installed in position on its shaft and minus the usual yarn wound around such core to define a bobbin, and also illustrating the outer end of the core in cross section to highlight its materials of construction.
Figure 4:
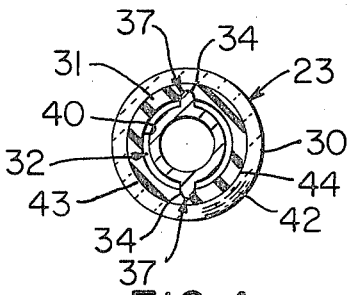
FIG. 4 is a cross-sectional view taken essentially on the line 4—4 of FIG. 3.

As indicated previously, the sleeve 31 is made of a yieldable resilient polymeric material and in the presentation of FIGS. 3 and 4 such sleeve is shown as being made of rubber. It will also be seen that the carrier shaft 32 of this example is a tubular shaft and has flangelike portions or projections extending from the outside periphery thereof and each projection is designated by the same reference numeral 34. The shaft 32 has a pair of coplanar diametrically opposed projections 34 extending outwardly from its inner portion as shown at 35 and has another pair of coplanar diametrically opposed projections 34 extending outwardly from its outer portion as shown at 36. The projections at 36 are in a plane substantially perpendicular to the plane of the projections at 35.

The projections 34 at the inner portion 35 of the shaft 32 provide improved frictional holding action because the sleeve 31 is yieldingly compressed between each projection 34 and the outer load-carrying structure 30 defining local indentations in the sleeve 31 and an increased surface area of frictional engagement and as shown at a pair of typical locations 37 in FIG. 4. A similar improved holding action is defined by the projections 34 at the outer portion of the shaft 32.

The resilient character of the rubber material defining the sleeve 31 assures that the inside surface 40 of the sleeve 31 basically returns to its original right circular cylindrical configuration once the core 23 is removed from its shaft 32. The core 23 is then ready to be reused in winding yarn 24 thereon to define another bobbin 22.

The load-carrying structure 30 of the core 23 is made of paper and such paper is in the form of a wound paper strip which is preferably in the form of a strip of recycled paper such as recycled newspaper. The strip is designated generally by the reference numeral 41 in FIG. 5 and defines the structure 30 having a plurality of turns indicated schematically by dot dash lines 42 in FIG. 4 which for convenience are extended over a small arc. The strip has a first turn 43 fastened to the sleeve 31 by adhesive means 44 which is also used to fasten the plurality of turns thereof. The adhesive means 44 cooperates with the adjoining turns 42 to define the load-carrying structure 30.

Figure 5:
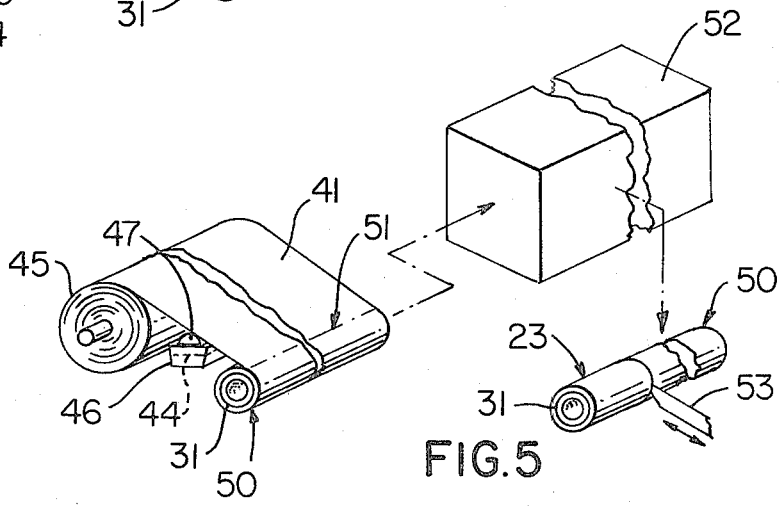
FIG. 5 is a view with certain parts shown schematically and other parts broken away illustrating method steps which may be employed in making the tubular core of FIGS. 1–4.

The core 23 is preferably made utilizing method steps illustrated in FIG. 5 of the drawing wherein such steps include forming a sleeve 31 of a yieldable resilient polymeric material and such sleeve may be formed utilizing any technique known in the art. The method further comprises providing a paper strip 41 and such strip may be provided on a supply roll 45 thereof and supported for unwinding rotation. The adhesive means 44 used to fasten the turns 42 is in the form of adhesive 44 which is contained in a suitable container 46 and applied to the strip 41 using an adhesive applying roller 47 and as the strip 41 is unwound from its supply roll 45. The adhesive applying roller 47 may have a suitable doctor blade, or the like, associated therewith to control the amount of adhesive applied.

The strip 41 is then suitably wound to define a what will be referred to as a tubular construction 50 once the desired length of the strip 41 has been wound in position, and with such desired length in position the strip is cut as shown by dot dash lines 51. The tubular construction 50 is then dried in a suitable drying device, such as an oven 52, to thereby dry the overall construction 50 and the adhesive 44. The tubular construction 50 is then cut into a plurality of desired lengths each defining an associated core 23 and the cutting may be achieved utilizing a suitable cutter 53 which is shown schematically.

Figure 7:
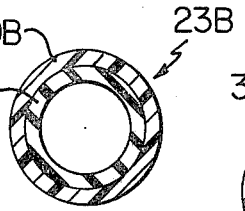
FIG. 7 is a view similar to FIG. 6 illustrating another exemplary embodiment of a tubular bobbin core of this invention.
Figure 8:
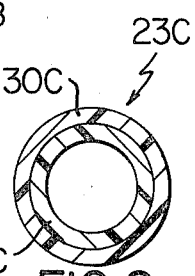
FIG. 8 is a view similar to FIG. 6 illustrating another exemplary embodiment of a tubular bobbin core of this invention.
Figure 6:
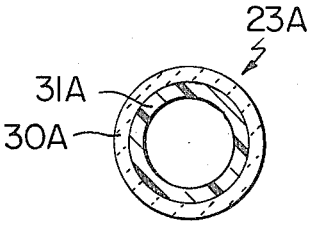
FIG. 6 is a cross-sectional view of another exemplary embodiment of a tubular bobbin core of this invention taken perpendicular the longitudinal axis of such core.

Other exemplary embodiments of tubular bobbin cores of this invention are illustrated in FIGS. 6, 7, and 8 of the drawing. The cores illustrated in FIGS. 6, 7, and 8 are very similar to the core 23; therefore, such cores will be designated by the reference numerals 23A, 23B, and 23C respectively and representative parts of each core which are similar to corresponding parts of the core 23 will be designated in the drawing by the same reference numerals as in the core 20 followed by the latter designation A, B, or C and not described again in detail.

The core 23A of FIG. 6 has its load-carrying structure 30A made of paper in a similar manner as described previously in connection with the structure 30; however, the core 23A has its inside portion or sleeve 31A made of a synthetic plastic material instead of rubber.

The core 23B of FIG. 7 has an inner portion or sleeve 31B made of polymeric material in the form of rubber similar to the rubber defining the inner portion 31 of core 23. However, the load-carrying structure 30B thereof is made of a second polymeric material which has a greater strength and rigidity than the polymeric material or rubber defining the sleeve 31B. The polymeric material defining the structure 30B is a synthetic plastic material.

The core 23C of FIG. 8 has its inner portion or sleeve 31C made of a polymeric material in the form of a synthetic plastic material which may be similar to the material of the sleeve 31A. The load-carrying structure 30C of core 23C is also made of a polymeric material which has greater strength and rigidity than the polymeric material of the sleeve 31C and, as shown by cross hatching in FIG. 8, the structure 30C is also made of a synthetic plastic material.

Each of the cores of this invention may be made with its inner sleeve made of rubber and its outer sleeve also of rubber which has greater strength and rigidity than the rubber of the inner sleeve. Further, this reference to making various portions of each core of rubber is intended to cover all types of rubber whether natural or synthetic.

Reference has also been made herein to the use of synthetic plastic material to define one or more component portions of each core. The term synthetic plastic material as used herein is intended to cover any material of high molecular weight which contains as an essential ingredient thereof a synthetic or semi-synthetic organic substance and is made by any one or more of known production processes.

The method steps used in making the core of this invention comprise steps of defining a load-carrying structure for the core and providing an inside portion for such core which is adapted to be engaged by a bobbin carrier shaft to provide frictional holding and cushioning action for the core in the manner previously mentioned. The inside portion of the core may be provided by forming a sleeve using any known process as long as such sleeve is made of a yieldable resilient polymeric material. For example, such a sleeve may be formed by extrusion process or any other suitable process. The step of defining the load-carrying structure comprises disposing the structure around and against the sleeve. Further, the defining of the load-carrying structure may also be achieved by extrusion process or by winding paper or similar web-like material around an inner sleeve.

Figure 9:
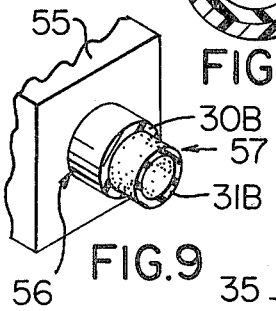
FIG. 9 is a fragmentary perspective view with parts broken away particularly illustrating a method which may be employed in making the tubular core of FIG. 7.

To highlight the simplicity with which a core of this invention may be made entirely of polymeric materials reference is now made to FIG. 9 which illustrates an exemplary extrusion apparatus 55 used to make such a core and wherein only a fragmentary portion of such apparatus is illustrated. The apparatus 55 has extrusion orifice means 56 through which a pair of concentric tubular sleeves are extruded and combined downstream of the orifice means to define an elongate member 57 from which a plurality of cores 23B may be cut. As is known in the art the apparatus 55 comprises a pair of extruders (not shown) wherein one extruder extrudes the inner rubber material defining the sleeve 31B and the outer extruder extrudes the outer synthetic plastic material defining sleeve or load-carrying structure 30B concentrically around and against sleeve 31B to define the elongate member 57. The member 57 is cut after curing and cooling to define a plurality of the cores 23B.

It will also be appreciated that the apparatus 55 may be suitably modified, as is known in the art, to provide an elongate member similar to the member 57 from which a plurality of cores 23C may be provided merely by co-extruding inner sleeve 31C made of one synthetic plastic material and outer sleeve 30C made of another.

The apparatus 55 may be further modified to define another type of core made entirely of rubber wherein the inner sleeve would be made of rubber having properties similar to the properties of sleeve 31 and the outer rubber sleeve may have physical properties similar to the properties of either structure 30B or 30C.

While present exemplary embodiments of this invention, and methods of practicing the same, have been illustrated and described, it will be recognized that this invention may be otherwise variously embodied and practiced within the scope of the following claims:

What is claimed is:

1. In a tubular core of a predetermined length for carrying yarn wound therearound to define a bobbin for a textile machine wherein said core has a load-carrying structure of said predetermined length and an inside portion which is adapted to be engaged by a carrier shaft to provide substantially frictional holding of said core and bobbin on said shaft, the improvement wherein said inside portion comprises a tubular sleeve of said predetermined length and made of a yieldable resilient polymeric material which is secured to said structure throughout said predetermined length thereof and which is adapted to be yieldingly compressed between said structure and at least parts of said shaft to provide said frictional holding of said core in an improved manner, and said yieldable resilient material of said sleeve enable said core and bobbin to be driven on said shaft while keeping said core substantially intact as well as enabling damage-free removal thereof to thereby define a reusable core.

2. A core as set forth in claim 1 in which said sleeve is made of rubber.

3. A core as set forth in claim 1 in which said sleeve is made of a synthetic plastic material.

4. A core as set forth in claim 1 in which said structure is made of paper.

5. A core as set forth in claim 4 in which said paper is a wound paper strip having a plurality of turns.

6. A core as set forth in claim 5 in which said wound paper strip is a strip of recycled paper.

7. In a tubular core for carrying yarn wound therearound to define a bobbin for a textile machine wherein said core has a load-carrying structure and an inside portion which is adapted to be engaged by a carrier shaft to provide substantially frictional holding of said core and bobbin on said shaft, the improvement wherein said inside portion comprises a sleeve made of a yieldable resilient polymeric material which is adapted to be yieldingly compressed between said structure and at least parts of said shaft to provide said frictional holding of said core in an improved manner, and said yieldable resilient material of said sleeve enables said core and bobbin to be driven on said shaft while keeping said core substantially intact as well as enabling damage-free removal thereof to thereby define a reusable core, said structure being made of paper, said paper being a wound paper strip having a plurality of turns, said paper strip having a first turn fastened to said sleeve and adhesive means fastening adjoining turns thereof.

8. A core as set forth in claim 7 in which said adhesive means cooperates with said adjoining turns of said paper to define said structure.

9. A core as set forth in claim 1 in which said structure is made of a second polymeric material which has a greater strength and rigidity than said first-named polymeric material.

10. A core as set forth in claim 9 in which said first-named polymeric material is rubber.

11. A core as set forth in claim 9 in which said first-named polymeric material is a synthetic plastic material.

12. A core as set forth in claim 9 in which said second polymeric material is a synthetic plastic material.

13. A core as set forth in claim 1 in which said sleeve has a thickness that is substantially the same as the thickness of said structure.

* * * * *